US009887482B2

(12) United States Patent
Lam et al.

(10) Patent No.: US 9,887,482 B2
(45) Date of Patent: Feb. 6, 2018

(54) CONNECTOR STRUCTURE

(71) Applicant: ASUSTek COMPUTER INC., Taipei (TW)

(72) Inventors: Jack Lam, Taipei (TW); Hao-Siang Min, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 0 days.

(21) Appl. No.: 15/485,233

(22) Filed: Apr. 12, 2017

(65) Prior Publication Data

US 2017/0310038 A1 Oct. 26, 2017

(30) Foreign Application Priority Data

Apr. 21, 2016 (TW) ..... 105112366 A

(51) Int. Cl.

| | |
|---|---|
| ***H01R 13/44*** | (2006.01) |
| ***H01R 13/447*** | (2006.01) |
| ***H01R 24/62*** | (2011.01) |
| *H01R 107/00* | (2006.01) |

(52) U.S. Cl.

CPC ..... *H01R 13/447* (2013.01); *H01R 24/62* (2013.01); *H01R 2107/00* (2013.01)

(58) Field of Classification Search

CPC ... H01R 2107/00; H01R 24/62; H01R 13/447
USPC ..... 439/144, 636, 632, 157
See application file for complete search history.

(56) References Cited

U.S. PATENT DOCUMENTS

| | | | | |
|---|---|---|---|---|
| 5,871,364 | A * | 2/1999 | Shinchi | H01R 13/447 439/144 |
| 6,190,186 | B1 * | 2/2001 | Liao | H01R 24/62 439/144 |
| 6,193,522 | B1 * | 2/2001 | Liao | H01R 25/003 439/144 |
| 6,971,921 | B1 * | 12/2005 | Lai | H01R 13/447 439/144 |
| 8,033,871 | B2 * | 10/2011 | Pocrass | H01R 23/10 439/344 |
| 8,951,054 | B2 * | 2/2015 | Byrne | H01R 13/447 307/104 |

(Continued)

FOREIGN PATENT DOCUMENTS

| | | |
|---|---|---|
| CN | 202868788 | 4/2013 |
| CN | 103401092 | 11/2013 |

*Primary Examiner* — Abdullah Riyami
*Assistant Examiner* — Nelson R Burgos-Guntin
(74) *Attorney, Agent, or Firm* — JCIPRNET

(57) ABSTRACT

A connector structure adapted to an electronic device is provided. The electronic device includes a housing with an open slot. The connector structure comprises a tongue-shaped portion, a covering component, and a connecting member. The tongue-shaped portion is pivotally connected to the housing and disposed in the open slot. The covering component is pivotally connected to the housing and for covering the open slot. The connecting member is disposed inside the open slot and connecting the tongue-shaped portion and the covering component. When the covering component drives the tongue-shaped portion to rotate simultaneously via the connecting member, a gap is formed between the tongue-shaped portion and the covering component to expose the open slot.

7 Claims, 5 Drawing Sheets

(56) References Cited

U.S. PATENT DOCUMENTS

| | | | | |
|---|---|---|---|---|
| 8,986,023 | B2 * | 3/2015 | Lee | H01R 13/447<br>439/138 |
| 2015/0056837 | A1 * | 2/2015 | Zhou | H01R 13/508<br>439/267 |
| 2015/0079824 | A1 * | 3/2015 | Dinnebier | F21V 21/35<br>439/121 |
| 2015/0132981 | A1 * | 5/2015 | McCammon | H02G 7/04<br>439/258 |

* cited by examiner

CONNECTOR STRUCTURE

CROSS-REFERENCE TO RELATED APPLICATION

This application claims the priority benefit of Taiwan application serial No. 105112366, filed on Apr. 21, 2016. The entirety of the above-mentioned patent application is hereby incorporated by references herein and made a part of specification.

BACKGROUND OF THE INVENTION

Field of the Invention

The disclosure relates to a connector structure.

Description of the Related Art

Universal Serial Bus (USB) is a serial bus standard for connecting an electronic product with an external device, and USB is also a technical specification for input and output interface. USB is widely used in personal desktop computers, notebooks, smart phones, tablets and other electronic products for transmitting signals or electric power. With the development of technology, USB has several specifications, such as Type-A, Type-B, Mini-A, Mini-B, Micro-A, Micro-B, 3.0 Micro-B, Type-C and OTG (On-The-Go). USB Type-C specification supports high-speed signal or electric power transmission. Furthermore, a USB Type-C connector is orientation-free, which means it can be plugged in either way. Therefore, the USB Type-C connectors are used by most manufacturers and are widely used.

Since the USB Type-C connector is usually exposed from an open slot of a housing of an electronic product, environmental dust or moisture easily enters into the USB Type-C connector, which impacts the signal or electric power transmission effect of the USB Type-C connector.

BRIEF SUMMARY OF THE INVENTION

According to an aspect of the disclosure, a connector structure adapted to an electronic device is provided. The electronic device includes a housing with an open slot. The connector structure comprises a tongue-shaped portion, a covering component, and a connecting member. The tongue-shaped portion is pivotally connected to the housing and disposed in the open slot. The covering component is pivotally connected to the housing and for covering the open slot. The connecting member is disposed inside the open slot and connecting the tongue-shaped portion and the covering component. When the covering component drives the tongue-shaped portion to rotate simultaneously via the connecting member, a gap is formed between the tongue-shaped portion and the covering component to expose the open slot.

In sum, in embodiments, the covering component of the connector structure is rotatably configured to the housing of the electronic device to cover or expose the open slot. When the covering component covers the open slot, the dust or moisture surround the electronic device would not drop onto the inserting component through the open slot, thus ensuring the signal or electric power transmission capability of the conductive terminal(s) on the inserting component.

On the other hand, when the covering component rotates relative to the housing and exposes the open slot, the covering component drives the inserting component to rotate simultaneously, the tongue-shaped portion of the inserting component moves out of the open slot when the slot is exposed. The rotation is continued until the tongue-shaped portion and the covering component have a gap therebetween and parallel to each other, that is, a space for the plug connector is formed. In other words, the connector structure has high reliability and operates more flexibly. Moreover, the electronic device with such a connector structure has a simple appearance.

BRIEF DESCRIPTION OF THE DRAWINGS

These and other features, aspects and advantages of the disclosure will become better understood with regard to the following embodiments and accompanying drawings.

DETAILED DESCRIPTION OF THE EMBODIMENTS

Figure 1A:
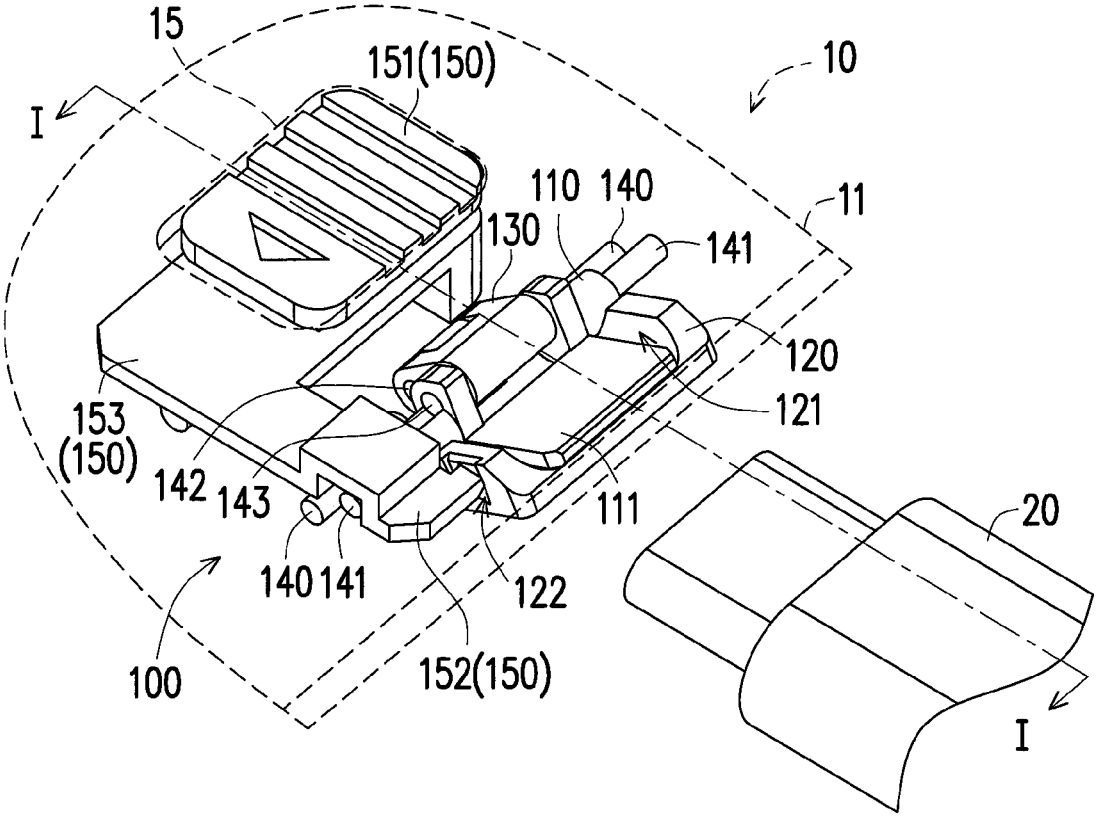
FIG. 1A is a schematic diagram showing a connector structure and an electronic device.
Figure 1B:
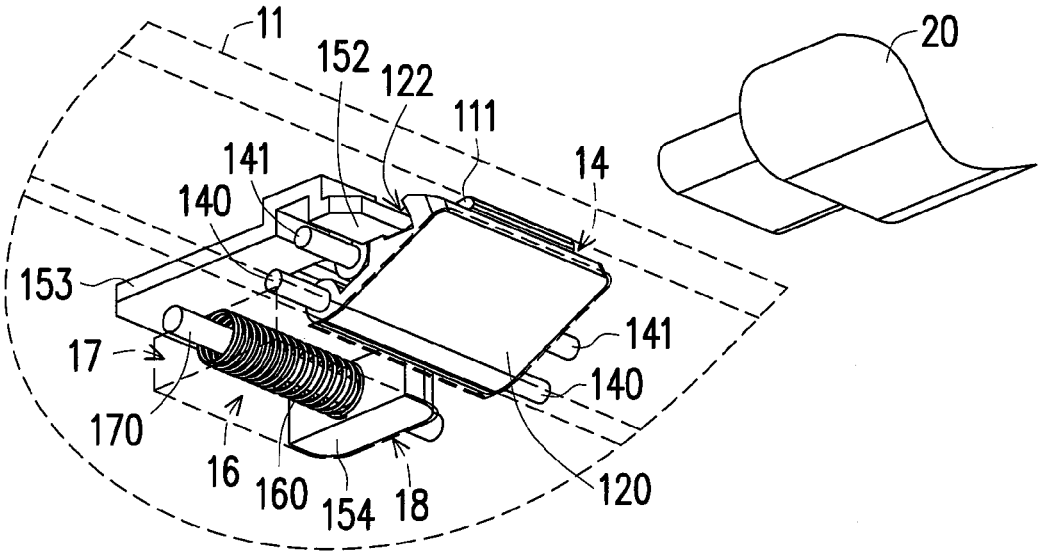
FIG. 1B is a schematic diagram showing the connector structure and the electronic device in FIG. 1A from another view.
Figure 1C:
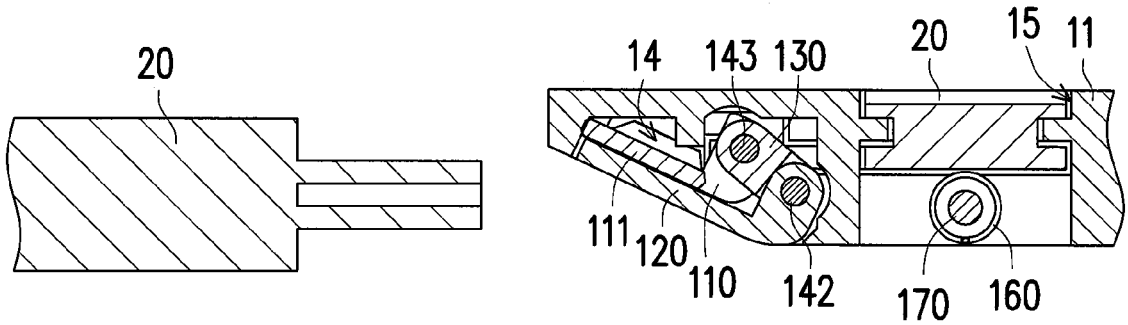
FIG. 1C is a sectional view of the connector structure and the electronic device in FIG. 1A along line I-I.

FIG. 1A is a schematic diagram showing a connector structure and an electronic device. FIG. 1B is a schematic diagram showing the connector structure and the electronic device in FIG. 1A from another view. FIG. 1C is a sectional view of the connector structure and the electronic device in FIG. 1A along line I-I. For illustrative purpose, a housing 11 of an electronic device 10 in FIG. 1A and FIG. 1B are shown in dotted lines. Please refer to FIG. 1A to FIG. 1C.

In the embodiment, a connector structure 100 is adapted for an electronic device 10. In an embodiment, the electronic device 10 is a notebook, and the connector structure 100 is assembled on the housing 11 of the main body of the electronic device 10. In other embodiments, the electronic device can be other kind of electronic device equipped with the connector structure for signal or electric power transmission, which is not limited herein.

In an embodiment, the connector structure 100 is a USB Type-C connector structure integrated into the electronic device 10. The housing 11 includes an open slot 14. The connector structure 100 includes an inserting component 110, a covering component 120 and a connecting member 130. The inserting component 110 is pivotally connected to the housing 11 and disposed inside the open slot 14. The covering component 120 is pivotally connected to the housing 11 to cover the open slot 14 and the inserting component 110. When the covering component 120 covers the open slot 14 and the inserting component 110, a plug connector 20 (such as, a USB Type-C plug connector) could not insert into the open slot 14 to combine with the inserting component 110.

Generally, the inserting component 110 includes an electrically insulated tongue-shaped portion 111. A plurality of conductive terminals (not shown) for transmitting signals or electric power are disposed at two opposite surfaces of the tongue-shaped portion 111. When the covering component 120 covers the open slot 14 and the inserting component 110, the environmental dust or moisture would not drop onto the inserting component 110 via the open slot 14, thus the signal or electric power transmission capability of the conductive terminals (not shown) is ensured.

On the other hand, when the covering component 120 covers the open slot 14 and the inserting component 110, the covering component 120 and the tongue-shaped portion 111 abut against each other. As shown in FIG. 1A, the covering component 120 includes a recess 121 for receiving the tongue-shaped portion 111.

The connecting member 130 is located inside the open slot 14 to connect the inserting component 110 with the covering component 120. In an embodiment, the connector structure 100 further includes two first shaft levers 140, two second shaft levers 141, a third shaft lever 142 and a fourth shaft lever 143.

The two first shaft levers 140 are disposed at opposite sides of the covering component 120 and passed through the covering component 120 and the housing 11, respectively. Thus, the covering component 120 is capable of rotating relative to the housing 11 via the two first shaft levers 140. The two second shaft levers 141 are disposed at the opposite sides of the inserting component 110 and passed through the inserting component 110 and the housing 11, respectively. Thus, the inserting component 110 is capable of rotating relative to the housing 11 via the two second shaft levers 141.

In the embodiment, the third shaft lever 142 connects the covering component 120 with the connecting member 130. The fourth shaft lever 143 connects the inserting component 110 with the connecting member 130. The third shaft lever 142 passes through the covering component 120 and an end of the connecting member 130 and is located between the two first shaft levers 140. The fourth shaft lever 143 passes through the inserting component 110 and another end of the connecting member 130 and is located between the two second shaft levers 141. Thus, when the covering component 120 rotates relative to the housing 11, the covering component 120 drives the inserting component 110 to rotate simultaneously via the connecting member 130.

In the embodiment, the connector structure 100 further includes a switching member 150. The switching member 150 is movably disposed at the housing 11. A groove 122 is formed at a side of the covering component 120. When the covering component 120 covers the open slot 14 and the inserting component 110, the groove 122 is located inside the open slot 14, and the switching member 150 and the groove 122 are interlocked. Since the switching member 150 and the groove 122 are interlocked, the covering component 120 could not rotate relative to the housing 11.

Consequently, the covering component 120 covers the open slot 14 and the inserting component 110 reliably until the plug connector 20 is inserted to combine with the inserting component 110. In an embodiment, the switching member 150 further includes a switching portion 151 and a hook portion 152. The housing 11 further includes a runner 15. The switching portion 151 is movably disposed in the runner 15. The hook portion 152 is disposed in the open slot 14. When the switching portion 151 is located at a first position (as shown in FIG. 1A) inside the runner 15, the hook portion 152 and the groove 122 are interlocked.

In an embodiment, the switching member 150 further includes a main body 153. The main body 153 is connected with the switching portion 151 and the hook portion 152. The connector structure 100 further includes an elastic member 160 and a position limiting rod 170. The elastic member 160 is disposed inside a position limiting slot 16 of the housing 11. The position of the elastic member 160 inside the position limiting slot 16 is fixed via the position limiting rod 170.

As shown in FIG. 1B, a side wall 154 of the main body 153 extends into the position limiting slot 16. The side wall 154 is located between a first wall 17 and a second wall 18 of the position limiting slot 16. The position limiting rod 170 is configured to pass through the first wall 17 and the second wall 18. The position limiting rod 170 passes through the side wall 154 and the elastic member 160 via the position limiting slot 16. In an embodiment, the elastic member 160 is a compression spring. Two ends of the elastic member 160 abut against the first wall 17 and the side wall 154, respectively.

Figure 2A:
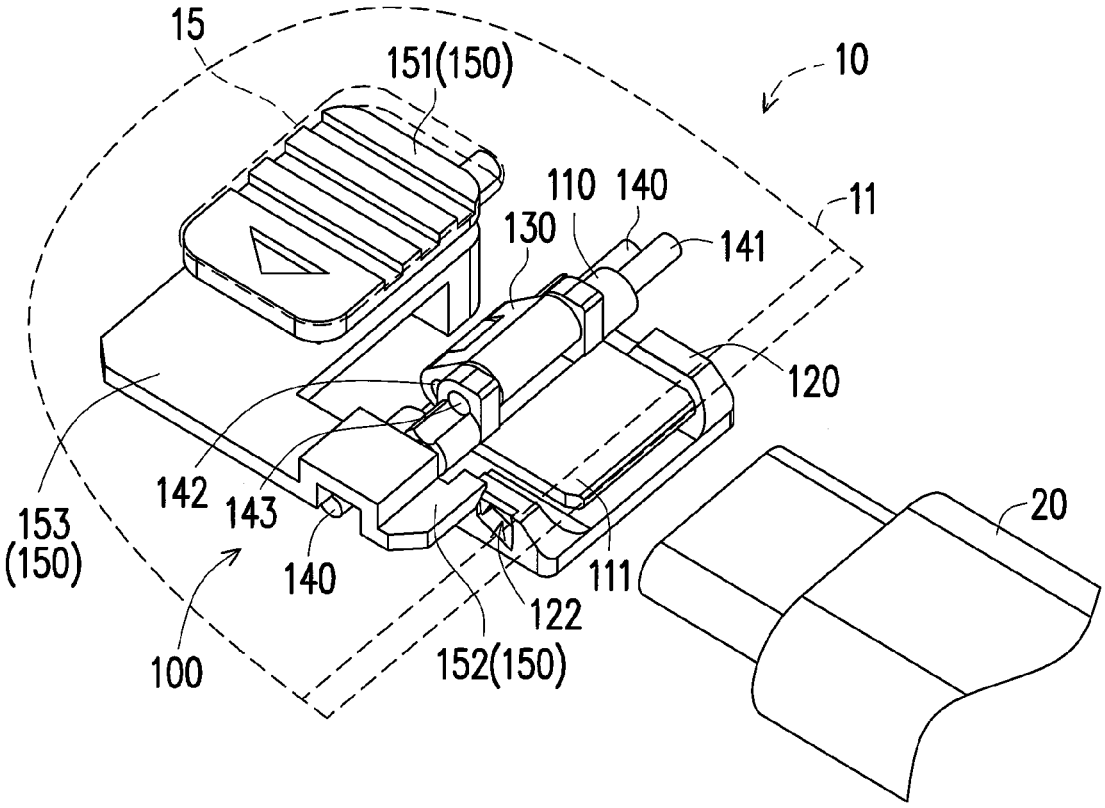
FIG. 2A is a schematic diagram showing that the covering component in FIG. 1A exposes an open slot and a tongue-shaped portion of an inserting component.
Figure 2B:
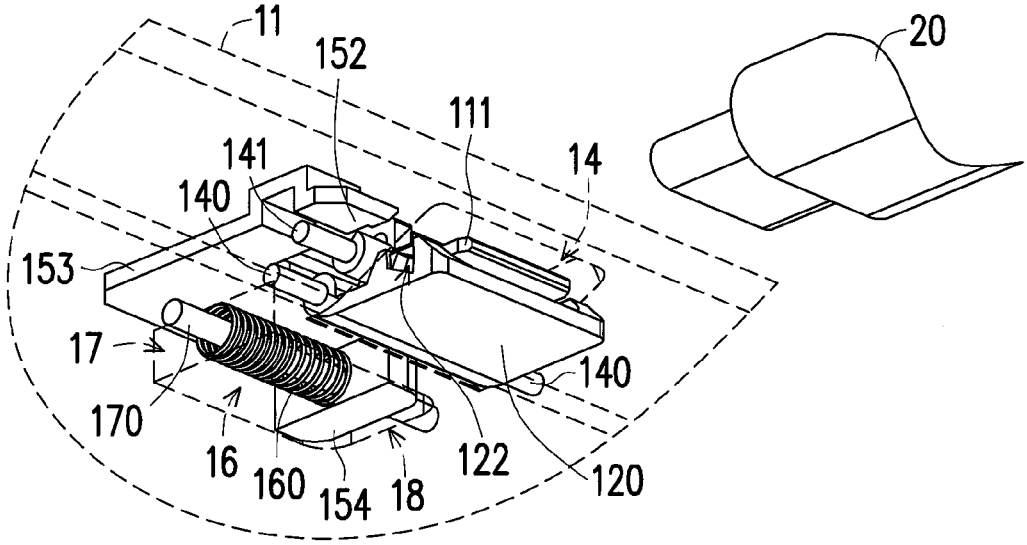
FIG. 2B is a schematic diagram showing the connector structure and the electronic device in FIG. 2A from another view.
Figure 3A:
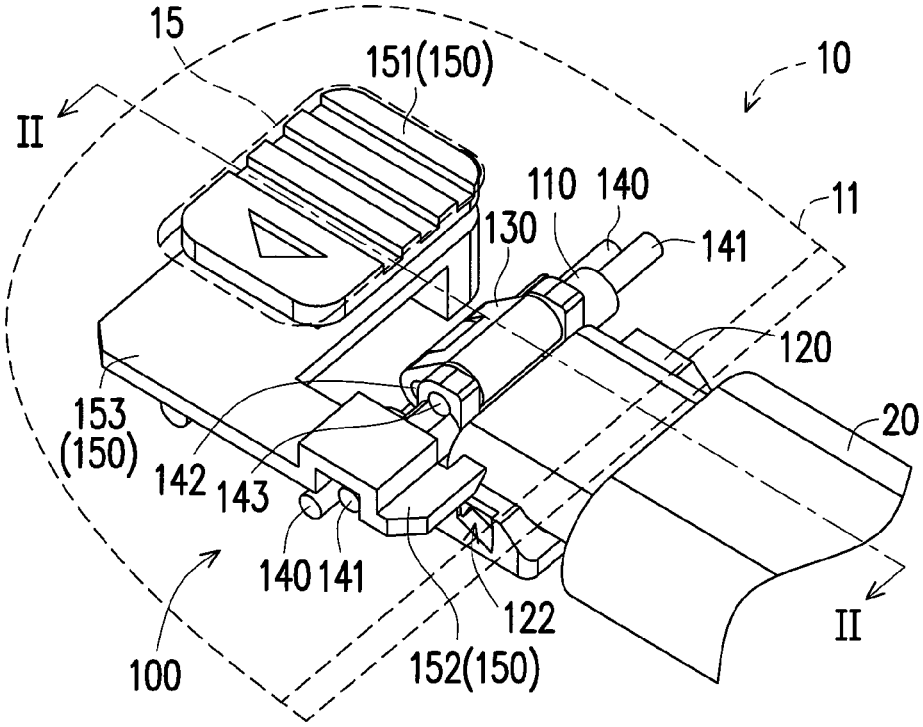
FIG. 3A is a schematic diagram showing that a plug is inserting into the connector structure in FIG. 2A.
Figure 3B:
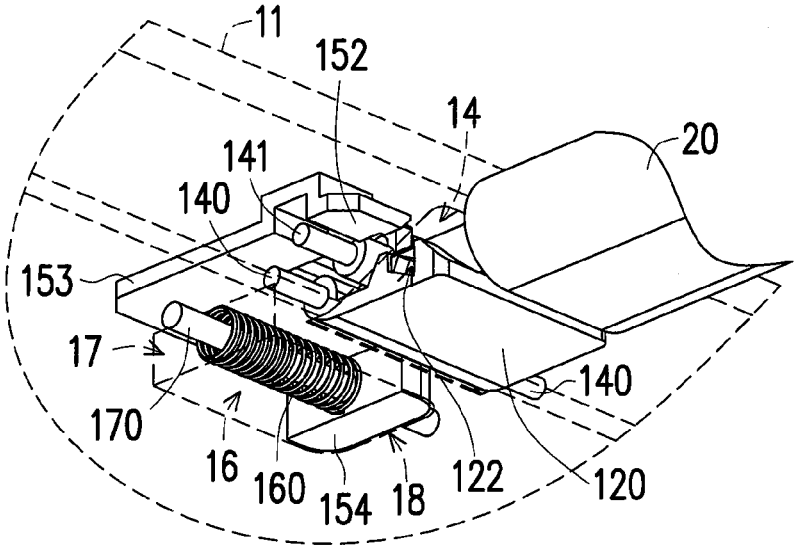
FIG. 3B is a schematic diagram showing the operating state in FIG. 3A from another view.
Figure 3C:
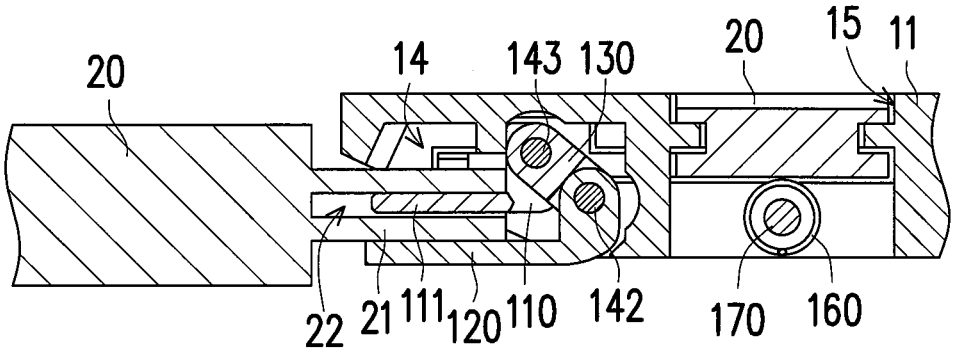
FIG. 3C is a sectional view of the connector structure and the electronic device in FIG. 3A along line II-II.

FIG. 2A is a schematic diagram showing an operating state in which the covering component in FIG. 1A exposes an open slot and a tongue-shaped portion of an inserting component. FIG. 2B is a schematic diagram showing the connector structure and the electronic device in FIG. 2A from another viewing angle. FIG. 3A is a schematic diagram showing an operating state in which a plug is inserting into the connector structure in FIG. 2A. FIG. 3B is a schematic diagram showing the operating state in FIG. 3A from another viewing angle. FIG. 3C is a sectional view of the connector structure and the electronic device in FIG. 3A along line II-II.

Please refer to FIG. 2A and the FIG. 2B. When an external force is applied to drive the switching portion 151 to move from the first position (as shown in FIG. 1A) to a second position (as shown in FIG. 2A) of the runner 15, the hook portion 152 is released from the groove 122. After the switching member 150 is disengaged from the covering component 120, the covering component 120 rotates relative to the housing 11 to move the groove 122 out of the open slot 14.

When the covering component 120 rotates relative to the housing 11, the covering component 120 drives the inserting component 110 to rotate simultaneously via the connecting member 130. As a result, a gap is formed between the tongue-shaped portion 111 and the covering component 120, the tongue-shaped portion 111 and the covering component 120 are parallel to each other (as shown in FIG. 3B), and the open slot 14 is exposed. After the open slot 14 is exposed, the tongue-shaped portion 111 moves out of the open slot 14.

When the switching portion 151 moves from the first position (as shown in FIG. 1A) to the second position (as shown in FIG. 2A), the side wall 154 moves toward the first wall 17 to compress the elastic member 160 between the first wall 17 and the side wall 154. When the external force applied to the switching portion 151 is removed, the elastic member 160 provides an elastic restoring force to drive the side wall 154 to move toward the second wall 18. Thus, the switching portion 151 returns back to the first position as shown in FIG. 3A.

Please refer to FIG. 3A to FIG. 3C. After the open slot 14 and the tongue-shaped portion 111 of the inserting component 110 are exposed, the covering component 120 and the tongue-shaped portion 111 that are in parallel define a space for a connecting plug 21 of the plug connector 20 to plug into the connector structure. When the connecting plug 21 moves into the open slot 14, the tongue-shaped portion 111 is inserted into an interface 22 of the connecting plug 21. In the embodiment, a plurality of conductive terminals (not shown) are configured at two opposite walls of the interface 22. The conductive terminals (not shown) on one of the surfaces of the tongue-shaped portion 111 contact with the conductive terminals (not shown) on one of the walls of the interface 22 to conduct signal or electric power transmissions.

In the embodiment, after the plug connector 20 is removed out of the open slot 14, a force is applied to drive the covering component 120 to rotate relative to the housing 11 until the covering component 120 covers the open slot 14 (a state shown in FIG. 1A). At the time, the covering component 120 drives the inserting component 110 to rotate simultaneously via the connecting member 130 to make the tongue-shaped portion 111 of the inserting component 110 move into the open slot 14.

When the covering component 120 rotates relative to the housing 11, the hook portion 152 of the switching member 150 is in the way the groove 122 of the covering component 120 passes by. Consequently, the hook portion 152 is locked in the groove 122 when the groove 122 moves into the open slot 14 (back to the state shown in FIG. 1A) by means of the movement of the switching member 150 and the elastic force of the elastic member 160.

In sum, the covering component of the connector structure is rotatably configured to the housing of the electronic device to cover or expose the open slot. When the covering component covers the open slot, the environmental dust or moisture would be blocked outside the open slot. The signal or electric power transmission capability of the conductive terminal(s) on the inserting component is thus ensured.

On the other hand, when the covering component rotates relative to the housing and exposes the open slot, the covering component drives the inserting component to rotate simultaneously, the tongue-shaped portion of the inserting component moves out of the open slot when the slot is exposed. The rotation is continued until the tongue-shaped portion and the covering component have a gap therebetween and parallel to each other, that is, a space for the plug connector is formed. In other words, the connector structure has high reliability and operates more flexibly. Moreover, the electronic device with such a connector structure has a simple appearance.

Although the disclosure has been disclosed with reference to certain embodiments thereof, the disclosure is not for limiting the scope. Persons having ordinary skill in the art may make various modifications and changes without departing from the scope of the disclosure. Therefore, the scope of the appended claims should not be limited to the description of the embodiments described above.

What is claimed is:

1. A connector structure, adapted to an electronic device having a housing with an open slot, the connector structure comprising:

a tongue-shaped portion, pivotally connected to the housing and disposed in the open slot;

a covering component, pivotally connected to the housing and for covering the open slot; and a connecting member, disposed inside the open slot and connecting the tongue-shaped portion and the covering component, wherein when the covering component drives the tongue-shaped portion to rotate simultaneously via the connecting member, a gap is formed between the tongue-shaped portion and the covering component to expose the open slot.

2. The connector structure according to claim 1, wherein the covering component includes a recess for receiving the tongue-shaped portion.

3. The connector structure according to claim 1, further comprising:

a switching member movably disposed at the housing, wherein a groove is formed at a side of the covering component, and the groove is located inside the open slot.

4. The connector structure according to claim 3, wherein the switching member includes a switching portion and a hook portion, the switching portion is movably configured in a runner of the housing, and the hook portion is located in the open slot.

5. The connector structure according to claim 4, wherein the switching member further includes a main body, the main body is connected with the switching portion and the hook portion, the connector structure further includes an elastic member, the elastic member is disposed inside a position limiting slot of the housing, a side wall of the main body extends into the position limiting slot, and the elastic member abuts against the side wall and one of walls of the position limiting slot.

6. The connector structure according to claim 5, wherein when the switching portion is located at a second position, the elastic member is compressed between the wall and the side wall.

7. The connector structure according to claim 5, wherein the connector structure further comprising:

a position limiting rod passing through the position limiting slot and the elastic member inside the position limiting slot.

* * * * *